US008947342B2

(12) United States Patent
Park et al.

(10) Patent No.: US 8,947,342 B2
(45) Date of Patent: Feb. 3, 2015

(54) METHOD AND APPARATUS FOR CONTROLLING THE PARTITIONS OF A BACKLIGHT UNIT OF A 3D DISPLAY APPARATUS

(75) Inventors: Sang-moo Park, Yongin-si (KR); Jong-hoon Jung, Suwon-si (KR); Dae-sik Kim, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 350 days.

(21) Appl. No.: 13/025,670

(22) Filed: Feb. 11, 2011

(65) Prior Publication Data

US 2011/0193897 A1 Aug. 11, 2011

Related U.S. Application Data

(60) Provisional application No. 61/303,358, filed on Feb. 11, 2010.

(30) Foreign Application Priority Data

Nov. 4, 2010 (KR) ..... 10-2010-0109252

(51) Int. Cl.

| | |
|---|---|
| ***G09G 3/36*** | (2006.01) |
| ***G09G 3/34*** | (2006.01) |
| ***G09G 3/00*** | (2006.01) |

(52) U.S. Cl.

CPC ..... *G09G 3/342* (2013.01); *G09G 3/003* (2013.01); *G09G 2310/08* (2013.01); *G09G 2320/064* (2013.01); *G09G 2360/16* (2013.01)

USPC ..... 345/102; 345/690; 349/15; 349/65

(58) Field of Classification Search

USPC ..... 345/102, 690; 348/E13.001, 51, 53; 349/15, 61, 65; 362/97.1–97.4, 362/600–634

See application file for complete search history.

(56) References Cited

U.S. PATENT DOCUMENTS

| | | | |
|---|---|---|---|
| 8,274,556 | B2 | 9/2012 | Cha et al. |
| 8,289,228 | B2 | 10/2012 | Arai |

(Continued)

FOREIGN PATENT DOCUMENTS

| | | | |
|---|---|---|---|
| CN | 101291440 | A | 10/2008 |
| CN | 101334555 | B | 11/2011 |

(Continued)

OTHER PUBLICATIONS

International Search Report (PCT/ISA/210) and Written Opinion (PCT/ISA/237) dated Oct. 24, 2011, issued in International Application No. PCT/KR2011/000890.

(Continued)

*Primary Examiner* — Koosha Sharifi-Tafreshi
(74) *Attorney, Agent, or Firm* — Sughrue Mion, PLLC

(57) ABSTRACT

A method and apparatus for controlling a backlight unit of a three-dimensional (3D) display apparatus receiving a 3D video sequence is provided. The method includes determining the image brightness level of the 3D video sequence displayed on a liquid crystal display (LCD) unit, for each of a plurality of partial regions of the LCD unit to which a plurality of sub-blocks of the backlight unit emit light; determining turn-on times of the plurality of sub-blocks of the backlight unit, based on the image brightness of each of the partial regions of the LCD unit; and determining turn-on periods of the plurality of sub-blocks of the backlight unit by synchronizing with a switching period between a set including a left visual point frame and a right visual point frame of the 3D video sequence.

21 Claims, 6 Drawing Sheets

(56) References Cited

U.S. PATENT DOCUMENTS

| | | | | |
|---|---|---|---|---|
| 8,736,542 | B2 | 5/2014 | Adachi | |
| 2005/0073625 | A1 | 4/2005 | Daiku et al. | |
| 2005/0184952 | A1 | 8/2005 | Konno et al. | |
| 2007/0126691 | A1 * | 6/2007 | Lin et al. | 345/102 |
| 2008/0084519 | A1 * | 4/2008 | Brigham et al. | 349/65 |
| 2008/0180381 | A1 * | 7/2008 | Jeong et al. | 345/99 |
| 2008/0186734 | A1 | 8/2008 | Huang et al. | |
| 2008/0258997 | A1 | 10/2008 | Arai | |
| 2008/0297463 | A1 | 12/2008 | Tsuru et al. | |
| 2008/0316596 | A1 | 12/2008 | Cha et al. | |
| 2009/0015536 | A1 | 1/2009 | Takeoka et al. | |
| 2009/0122087 | A1 * | 5/2009 | Maruyama et al. | 345/690 |
| 2009/0267890 | A1 | 10/2009 | Park et al. | |
| 2010/0020062 | A1 | 1/2010 | Liou et al. | |
| 2010/0156964 | A1 * | 6/2010 | Masuda et al. | 345/691 |
| 2010/0220048 | A1 * | 9/2010 | Yamamura et al. | 345/102 |
| 2010/0289883 | A1 | 11/2010 | Goris et al. | |

FOREIGN PATENT DOCUMENTS

| | | | |
|---|---|---|---|
| JP | 2009025436 | A | 2/2009 |
| JP | 2009134237 | A | 6/2009 |
| JP | 2009139930 | A | 6/2009 |
| WO | WO 2007032124 | A1 * | 3/2007 |
| WO | WO 2008/045681 | A1 | 4/2008 |
| WO | 2009/069026 | A2 | 6/2009 |

OTHER PUBLICATIONS

Communication dated Feb. 13, 2014, issued by the European Patent Office in counterpart European Application No. 11742479.6.

Communication dated Jun. 23, 2014 issued by State Intellectual Property Office of People's Republic of China in counterpart Chinese application No. 201180008820.

Communication dated Nov. 11, 2014, issued by the Japanese Intellectual Property Office in counterpart Japanese Application No. 2012-552805.

* cited by examiner

METHOD AND APPARATUS FOR CONTROLLING THE PARTITIONS OF A BACKLIGHT UNIT OF A 3D DISPLAY APPARATUS

CROSS-REFERENCE TO RELATED PATENT APPLICATION

This application claims the benefit of U.S. Provisional Patent Application No. 61/303,358, filed on Feb. 11, 2010, in the U.S. Patent and Trademark Office, and the benefit of Korean Patent Application No. 10-2010-0109252, filed on Nov. 4, 2010, in the Korean Intellectual Property Office, the disclosures of which are incorporated herein their entirety by reference.

BACKGROUND

1. Field

The present invention relates to a structure of a three-dimensional (3D) display apparatus and a method of driving the 3D display apparatus.

2. Description of the Related Art

Due to recent commercialization and wide spread availability of three-dimensional (3D) displays, consumers are becoming more interested in having a 3D display apparatus. In order to create a 3D display, the 3D display apparatus constantly maintains a turn-on time of a light source. A light source of a backlight unit is turned on having the same brightness level for both a dim image and a bright image. In a 3D display apparatus, a ghosting phenomenon may occur due to a liquid crystal response speed in a 3D display mode, causing a user to experience an unnatural feeling. Thus, there is an increasing demand of viewers who desire to comfortably watch 3D contents using a 3D display apparatus.

SUMMARY

According to an aspect of the exemplary embodiments, there is provided a method of controlling a backlight unit of a three-dimensional (3D) display apparatus formed of a liquid crystal display (LCD) unit, a backlight unit and a light guide plate. The method of controlling the backlight unit includes the operations of inputting a 3D video sequence to the 3D display apparatus; determining the image brightness level of the 3D video sequence displayed on the LCD unit, for each of partial regions of the LCD unit to which a plurality of sub-blocks of the backlight unit emit light; determining turn-on times for a plurality of sub-blocks of the backlight unit, based on the image brightness of each of the partial regions of the LCD unit, and determining turn-on periods of the plurality of sub-blocks of the backlight unit by synchronizing with a switching period between a set including a left visual point frame and a right visual point frame, of the 3D video sequence.

The operation of determining the turn-on times may include adjusting the turn-on times to be long when the brightness level of each of the partial regions of the 3D video sequence is high. The operation of determining the turn-on times may also include adjusting the turn-on times to be short when the brightness level of each of the partial regions of the 3D video sequence is low.

The method may further include turning on and off each of the plurality of sub-blocks of the backlight unit repeatedly, based on the turn-on periods and the turn-on times of the plurality of sub-blocks of the backlight unit, which are separately adjusted by being synchronized with a frame period of the 3D video sequence.

According to another aspect of the exemplary embodiments, there is provided a three-dimensional (3D) display apparatus including a liquid crystal display (LCD) unit displaying an image of an input 3D video sequence; a backlight unit partitioned into a plurality of sub-blocks that separately emit light to the LCD unit; a light guide plate delivering the light emitted from the backlight unit; and a control unit of the backlight unit which controls light sources of the backlight unit, wherein the control unit of the backlight unit includes a sub-block turn-on time determining unit which determines the image brightness level of the 3D video sequence displayed on the LCD unit, for each of partial regions of the LCD unit to which the plurality of sub-blocks of the backlight unit emit light, and determining turn-on times of the plurality of sub-blocks of the backlight unit, based on the image brightness of each of the partial regions of the LCD unit; and a determining unit for a sub-block turn-on period which determines turn-on periods of the plurality of sub-blocks of the backlight unit, the determinations being performed by the turn-on periods by synchronizing with a switching period between a set of a left visual point frame and a right visual point frame of the 3D video sequence.

Also provided is a computer readable recording medium having recorded thereon a program for executing the method of controlling a backlight unit of a three-dimensional (3D) display apparatus.

BRIEF DESCRIPTION OF THE DRAWINGS

The above and other features and advantages of the exemplary embodiments will become more apparent by describing in detail exemplary embodiments thereof with reference to the attached drawings in which.

DETAILED DESCRIPTION

Hereinafter, the exemplary embodiments will be described in detail by explaining the exemplary embodiments with reference to the attached drawings.

Figure 1:
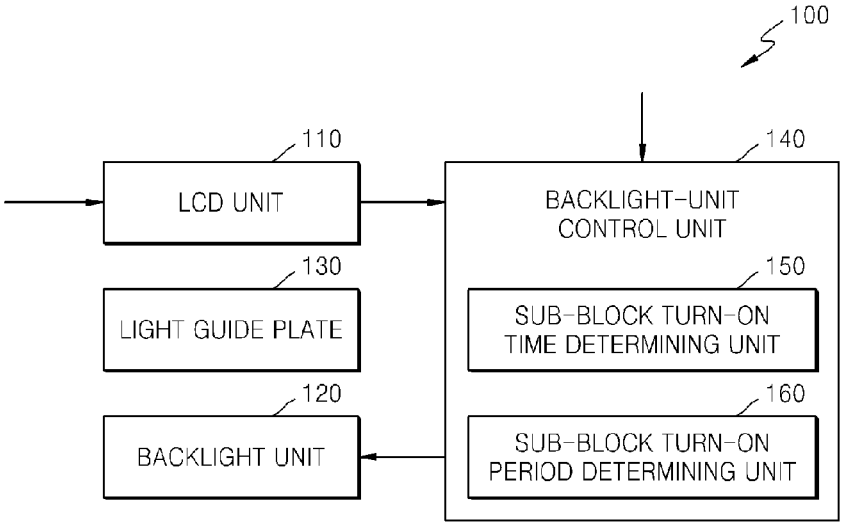
FIG. 1 is a block diagram of a three-dimensional (3D) display apparatus according to an exemplary embodiment.

FIG. 1 is a block diagram of a three-dimensional (3D) display apparatus 100 according to an exemplary embodiment.

3D display apparatus 100 includes a liquid crystal display (LCD) unit 110, a backlight unit 120, a light guide plate 130, and a control unit 140 for the backlight unit.

LCD unit 110 visually displays an image signal of a video sequence input to 3D display apparatus 100. Backlight unit 120 includes one or more light sources emitting light to the LCD unit 110, so that an image on an LCD panel is well displayed to a viewer. Light guide plate 130 is a structure that allows the light emitted from backlight unit 120 to be efficiently delivered to LCD unit 110.

Backlight unit 120 may be partitioned into a plurality of sub-blocks, respectively, having light sources and may emit light toward LCD unit 110 in a manner that the light source is controlled to be separately turned on and off in each of the sub-blocks.

Backlight unit 120 may have a one-sided edge structure in which light sources are positioned to emit light to one surface of LCD unit 110, or may have a two-sided edge structure in which light sources are positioned to emit light to two surfaces of LCD unit 110. One surface of LCD unit 110 may be one of an upper part and a lower part of LCD unit 110 or may be one of a left part or a right part of LCD unit 110. Two surfaces of LCD unit 110 may be the upper part and the lower part of LCD unit 110 or may be the left part and the right part of LCD unit 110.

Light guide plate 130 may be formed of one plate and may deliver light, which is emitted to backlight unit 120 from the sub-blocks.

In order to allow light guide plate 130 to separately deliver light that is emitted from each of the sub-blocks of backlight unit 120, light guide plate 130 may be partitioned into a plurality of sub-plates that are parallel with directions in which the respective sub-blocks emit light. For example, if the sub-blocks of backlight unit 120 emit light in a vertical direction, light guide plate 130 may be partitioned into a plurality of sub-plates that are parallel with the vertical direction in which the light travels.

Light guide plate 130 may be partitioned into a plurality of sub-plates according to a side edge structure of backlight unit 120. For example, if backlight unit 120 has a two-sided edge structure, light guide plate 130 may be partitioned into upper and lower (or left and right) sub-plates so that upper and lower (or left and right) sub-plates of backlight unit 120 may be partitioned into light emission regions.

In order to allow light that is emitted from each of the sub-blocks of backlight unit 120 to be delivered to LCD unit 110 via each of the partitioned sub-plates of light guide plate 130, the sub-plates of light guide plate 130 may be partitioned according to positions of the respective sub-blocks of backlight unit 120 and the two-sided edge structure. For example, light guide plate 130 may be partitioned into sub-plates that are parallel with positions at which respective light sources of the respective sub-blocks of backlight unit 120 emit light, and simultaneously, light guide plate 130 may be partitioned into upper and lower sub-plates according to the two-sided edge structure in which light is emitted from upper and lower parts of backlight unit 120.

The control unit 140 of the backlight unit controls a turn-on time and a turn-on period of each light source of backlight unit 120. In order to separately control the sub-blocks of backlight unit 120, the control unit 140 of the backlight unit includes a sub-block turn-on time determining unit 150 and a sub-block turn-on period determining unit 160.

The control unit 140 of the backlight unit also determines the turn-on time of backlight unit 120 based on the brightness level of an image displayed on LCD unit 110. The turn-on time according to the present embodiment may also be expressed as a back light unit (BLU) duty ratio. The control unit 140 of the backlight unit may adjust the turn-on time such that a turn-on time of a corresponding sub-block is short when the brightness level of an image displayed on LCD unit 110 becomes low. The turn-on time of a corresponding sub-block is adjusted to be long when the brightness level of an image displayed on LCD unit 110 becomes high.

Sub-block turn-on time determining unit 150 may adjust the image brightness level of a 3D video sequence displayed on LCD unit 110 according to each of the regions of LCD unit 110, to which the sub-blocks of backlight unit 120 emit light. Sub-block turn-on time determining unit 150 may directly receive a sub-block turn-on time and may directly measure the brightness level of an image displayed on LCD unit 110. Sub-block turn-on time determining unit 150, according to another embodiment, may obtain data about the image brightness level from an external source.

Sub-block turn-on time determining unit 150 may also determine a turn-on time of each sub-block of backlight unit 120 based on the brightness level of an image displayed on each of regions of LCD unit 110. Sub-block turn-on time determining unit 150 may determine a turn-on time of each sub-block of backlight unit 120 based on the brightness level of an image in a region of each sub-block of backlight unit 120 which emits light.

Sub-blocks of backlight unit 120 may be separately controlled but the sub-blocks may be classified into groups, respectively, including the predetermined number of sub-blocks that are sequentially arranged and may be controlled according to the groups. That is, sub-block turn-on time determining unit 150 may classify the sub-blocks of backlight unit 120 into a predetermined number of groups; may determine the brightness level of an image of each region of LCD unit 110 to which the sub-blocks emit light, according to each of the groups of the sub-blocks, and may separately determine a turn-on time for each of the groups according to the determination.

Sub-block turn-on period determining unit 160 may determine a turn-on period of the sub-blocks of backlight unit 120, so that backlight unit 120 may be turned on while synchronizing with a frame period of a 3D video sequence. Sub-block turn-on period determining unit 160 may determine the turn-on period of the sub-blocks of backlight unit 120 based on a switching period between the left and right visual points, in a set including left and right visual point frames of the 3D video sequence.

For example, the 3D display apparatus 100 may display a first frame set for displaying a set of a first left visual point frame and a first right visual point frame of the 3D video sequence, in an order of the first left visual point frame, the first left visual point frame, the first right visual point frame, and the first right visual point frame. That is, the first frame set may be displayed by twice repeating the first left visual point frame and the first right visual point frame.

3D display apparatus 100 may also display a second frame set, in an order of a first left visual point frame, a black frame, a first right visual point frame, and a black frame. That is, although the second frame set is displayed by repeating the first left visual point frame and the first right visual point frame once, the black frame may be displayed between the first right visual point frame and the first right visual point frame.

Thus, in a situation where 3D display apparatus 100 displays the 3D video sequence by a unit of the first frame set or by a unit of the second frame set, although a frame period of the 3D video sequence is 240 Hz, a switching period between a left visual point frame and a right visual point frame is 240/2=120 Hz, so that the sub-block turn-on period determining unit 160 may determine the turn-on period in synchronization with the switch period between left and right visual points.

When N frames are displayed before left and right visual points of a set of left and right visual point frames are switched, sub-block turn-on period determining unit 160 may determine the turn-on period of the sub-blocks of backlight unit 120 as 1/N of the frame period of the 3D video sequence, where N is an integer equal to or greater than 2.

Thus, the turn-on period of the sub-blocks of backlight unit 120 may be determined to be N times slower than the frame period of the 3D video sequence. This is in consideration of the features of the 3D video sequence in which a left visual point frame and a right visual point frame are alternated and in which one or more frames may be displayed before left and right visual points of a set of left and right visual point frames are switched.

Accordingly, the control unit 140 of the backlight unit may repeat the turning on and off of each of the sub-blocks of backlight unit 120 based on the both of the turn-on period of the sub-blocks of backlight unit 120 and the turn-on time adjusted in each of the sub-blocks, wherein the turn-on period is determined in synchronization with the frame period of the 3D video sequence and the switching period between left and right visual points.

Control unit 140 of the backlight unit may separately control the turn-on time of each of the sub-blocks of backlight unit 120. Thus, the turn-on times of the sub-blocks of backlight unit 120 may be equal to or different from each other. Also, when backlight unit 120 has the two-sided edge structure, the control unit 140 of the backlight unit may separately control sub-blocks of a first side of the backlight unit 120, and may separately control the sub-blocks of a second side of backlight unit 120. Thus, a turn-on time of the sub-blocks of the first side of backlight unit 120 may be equal to or different from a turn-on time of the sub blocks of the second side of backlight unit 120.

Thus, based on the image brightness level of each region of the 3D video sequence to be displayed by the 3D display apparatus 100, a turn-on time of sub-blocks from among the sub-blocks of the backlight unit 120 which emit light to a bright image region is adjusted to be relatively long. A turn-on time of sub-blocks which emit light to a dim image region is adjusted to be relatively short. As a result, it is possible to minimize the "ghosting phenomenon" that may occur when 3D video contents are displayed.

Hereinafter, referring to FIGS. 2 through 4, 3D display apparatuses 200, 300, and 400, including examples of backlight unit 120 and light guide plate 130 of 3D display apparatus 100, are provided. Thus, a backlight unit of each of the 3D display apparatuses 200, 300, and 400 may be controlled by the control unit 140 of the backlight unit of 3D display apparatus 100.

Figure 2:
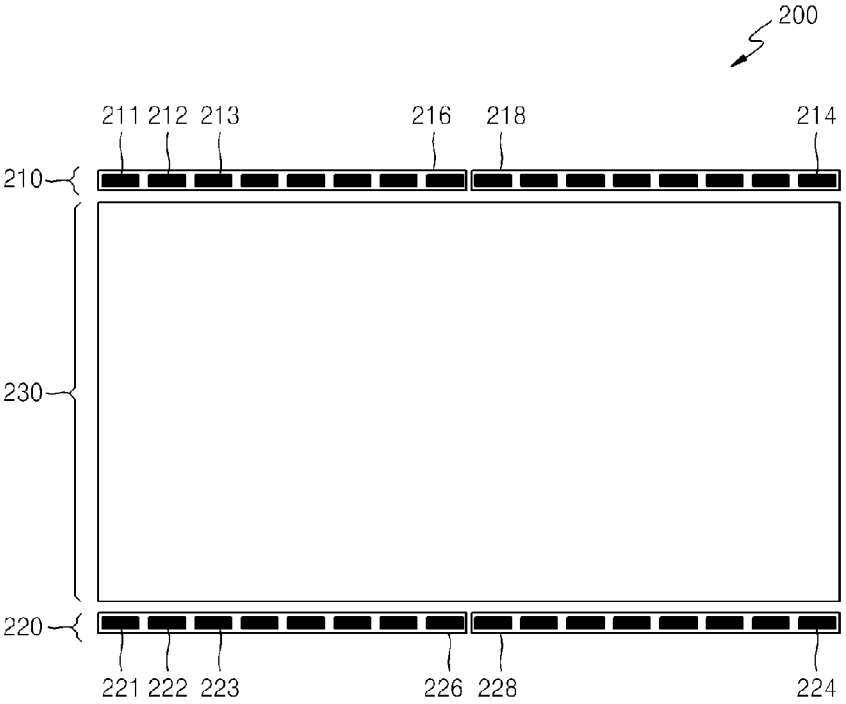
FIG. 2 illustrates a 3D display apparatus including a backlight unit having a two-sided edge structure according to another exemplary embodiment.

FIG. 2 illustrates a 3D display apparatus 200 including a backlight unit having a two-sided edge structure according to another exemplary embodiment.

3D display apparatus 200 includes the backlight unit having the two-sided edge structure including an upper backlight unit 210 and a lower backlight unit 220. Upper backlight unit 210 is partitioned into sub-blocks 211, 212, 213, . . . , 214, and the lower backlight unit 220 is partitioned into sub-blocks 221, 222, 223, . . . , 224. A light guide plate 230 of 3D display apparatus 200 may transmit light emitted from the sub-blocks 211, 212, 213, . . . , 214 of upper backlight unit 210 and sub-blocks 221, 222, 223, . . . , 224 of lower backlight unit 220.

The control unit 140 of the backlight unit may classify sub-blocks 211, 212, 213, . . . , 214, 221, 222, 223, . . . , 224 of upper backlight unit 210 and the lower backlight unit 220 into the predetermined number of groups, and may control each of the groups. For example, sub-blocks 211, 212, 213, . . . , 214 of the upper backlight unit 210 are classified into two sub-block groups 216 and 218, and a turn-on time may be determined for each of sub-block groups 216 and 218. Similarly, sub-blocks 221, 222, 223, . . . , 224 of lower backlight unit 220 are classified into two sub-block groups 226 and 228, and a turn-on time may be determined for each of sub block groups 226 and 228. However, upper backlight unit 210 and lower backlight unit 220 are not always classified into the same number of sub-block groups.

While FIG. 2 illustrates 3D display apparatus 200 including the backlight unit having the two-sided edge structure, in a situation where a backlight unit has a one-side edge structure including only an upper backlight unit or a lower backlight unit, a turn-on time may also be separately controlled for each of sub-blocks of the backlight unit or each of sub-block groups of the backlight unit.

Figure 3:
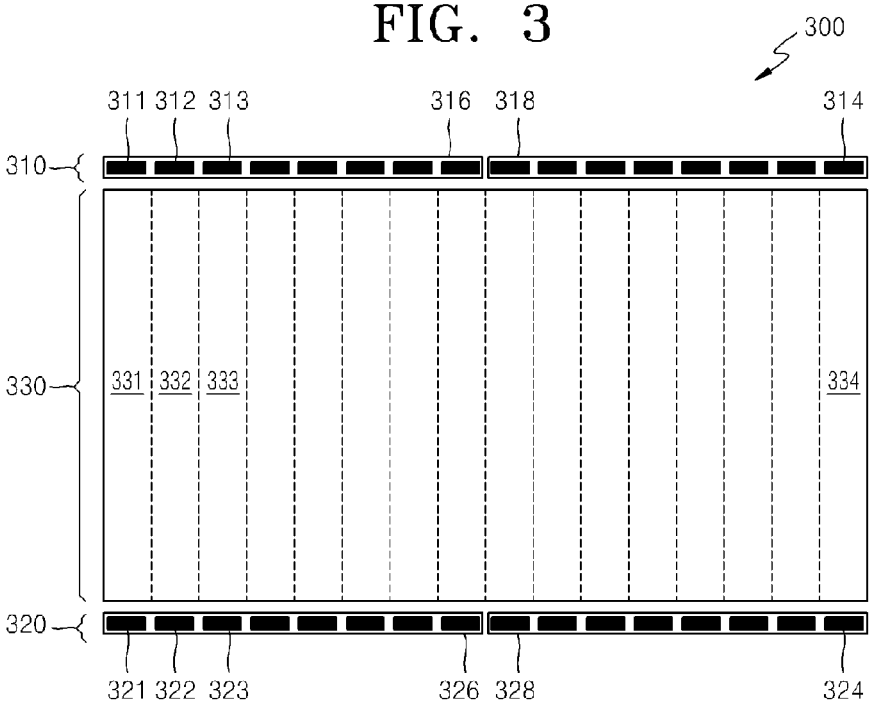
FIG. 3 illustrates a 3D display apparatus including a backlight unit having a two-sided edge structure, and a light guide plate partitioned according to an emission direction of the backlight unit according to another exemplary embodiment.

FIG. 3 illustrates a 3D display apparatus 300 including a backlight unit having a two-sided edge structure, and a light guide plate 330 partitioned according to an emission direction of the backlight unit according to another exemplary embodiment.

3D display apparatus 300 includes the backlight unit having the two-sided edge structure including an upper backlight unit 310 and a lower backlight unit 320. Upper backlight unit 310 is partitioned into sub-blocks 311, 312, 313, . . . , 314, and lower backlight unit 320 is partitioned into sub-blocks 321, 322, 323, . . . , 324.

Light guide plate 330 is partitioned into sub-plates 331, 332, 333, . . . , 334 according to positions of sub-blocks 311, 312, 313, . . . , 314, 321, 322, 323, . . . , 324 of upper backlight unit 310 and lower backlight unit 320 so as to be parallel with a direction of light emitted from the backlight unit. Thus, light emitted from facing sub-blocks from among sub-blocks 311, 312, 313, . . . , 314 of upper backlight unit 310 and sub-blocks 321, 322, 323, . . . , 324 of lower backlight unit 320 may be delivered to LCD unit 110 without being dispersed to another sub-plate.

Control unit 140 of the backlight unit may classify sub blocks 311, 312, 313, . . . , 314 of upper backlight unit 310 into two sub-block groups 316 and 318 and may determine a turn-on time for each of sub-block groups 316 and 318. Similarly, the control unit 140 of the backlight unit may classify sub-blocks 321, 322, 323, . . . , 324 of lower backlight unit 320 into two sub-block groups 326 and 328 and may determine a turn-on time for each of sub-block groups 326 and 328.

As described above, while FIGS. 2 and 3 illustrate the 3D display apparatuses 200 and 300 respectively including the backlight unit having the two-sided edge structure, in a situation where a backlight unit has a one-sided edge structure including only an upper backlight unit or only a lower backlight unit, a turn-on time may also be separately controlled for each of sub-blocks of the backlight unit or for each of the sub-block groups of the backlight unit.

Figure 4:
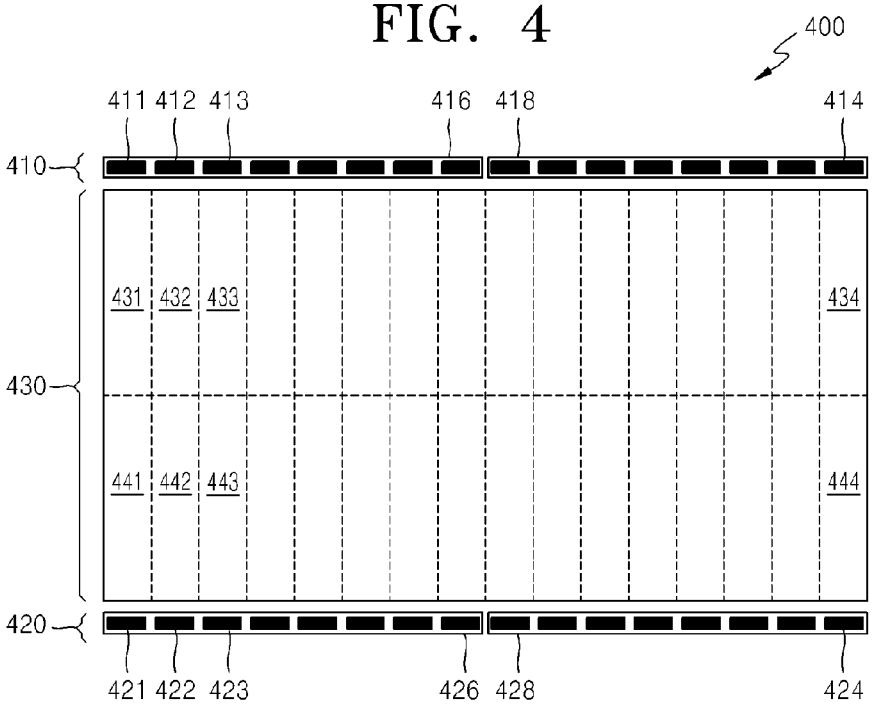
FIG. 4 illustrates a 3D display apparatus including a backlight unit having a two-sided edge structure, a light guide plate partitioned according to an emission direction, and a side edge structure of the backlight unit according to another exemplary embodiment.

FIG. 4 illustrates a 3D display apparatus 400 including a backlight unit having a two-sided edge structure, and a light guide plate 430 partitioned according to an emission direction and a side edge structure of the backlight unit according to another exemplary embodiment.

3D display apparatus 400 includes the backlight unit having the two-sided edge structure including an upper backlight unit 410 and a lower backlight unit 420. Upper backlight unit 410 is partitioned into sub-blocks 411, 412, 413, . . . , 414, and the lower backlight unit 420 is partitioned into sub-blocks 421, 422, 423, . . . , 424.

Light guide plate 430 of 3D display apparatus 400 is vertically partitioned while being partitioned according to positions of the sub-blocks 411, 412, 413, . . . , 414 of the upper backlight unit 410 and the sub-blocks 421, 422, 423, . . . , 424 of the lower backlight unit 420, so as to be parallel with a direction of light. That is, light guide plate 430 is partitioned into sub-plates 431, 432, 433, . . . , 434, 441, 442, 443, . . . , 444, so that light emitted from each of sub-blocks 411, 412, 413, . . . , 414, 421, 422, 423, . . . , 424 of upper backlight unit 410 and lower backlight unit 420 may pass through sub-plates 431, 432, 433, . . . , 434, 441, 442, 443, . . . , 444 toward a target region without being dispersed to another sub-plate.

As described above with reference to the previous exemplary embodiments, control unit 140 of the backlight unit may separately determine a turn-on time of each of sub-block groups 416, 418, 426, and 428 from among the sub-block groups 416 and 418 of an upper backlight unit 410 and the sub-block groups 426 and 428 of a lower backlight unit 420. In 3D display apparatuses 200, 300, and 400 described above with reference to FIGS. 2 through 4, the number of the sub-block groups may be randomly adjusted. Upper backlight units 210, 310, and 410 and lower backlight units 220, 320, and 420 are not always classified into the same number of sub-block groups and controlled in the same fashion. Thus, the upper backlight units and the lower backlight units may be classified into a different number of sub-block groups and are separately controlled.

Figure 5:
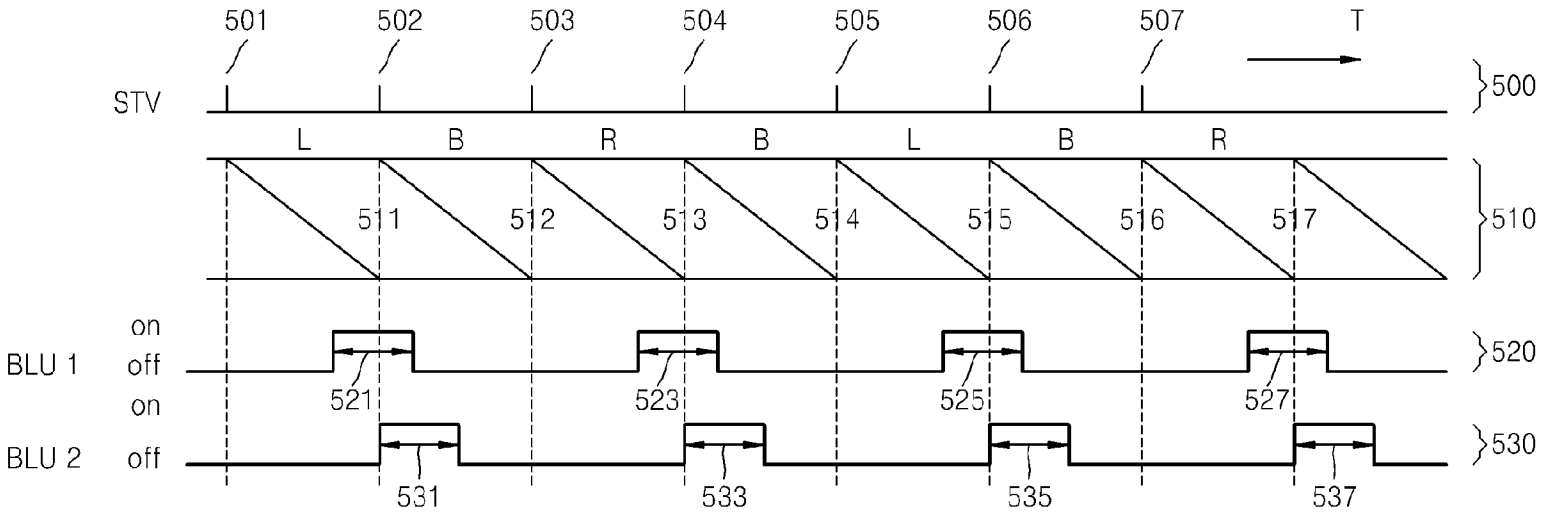
FIG. 5 is a timing diagram of a turn-on time of a backlight unit which is adjusted according to the one or more embodiments, when the image brightness level of a 3D video sequence is low.
Figure 6:
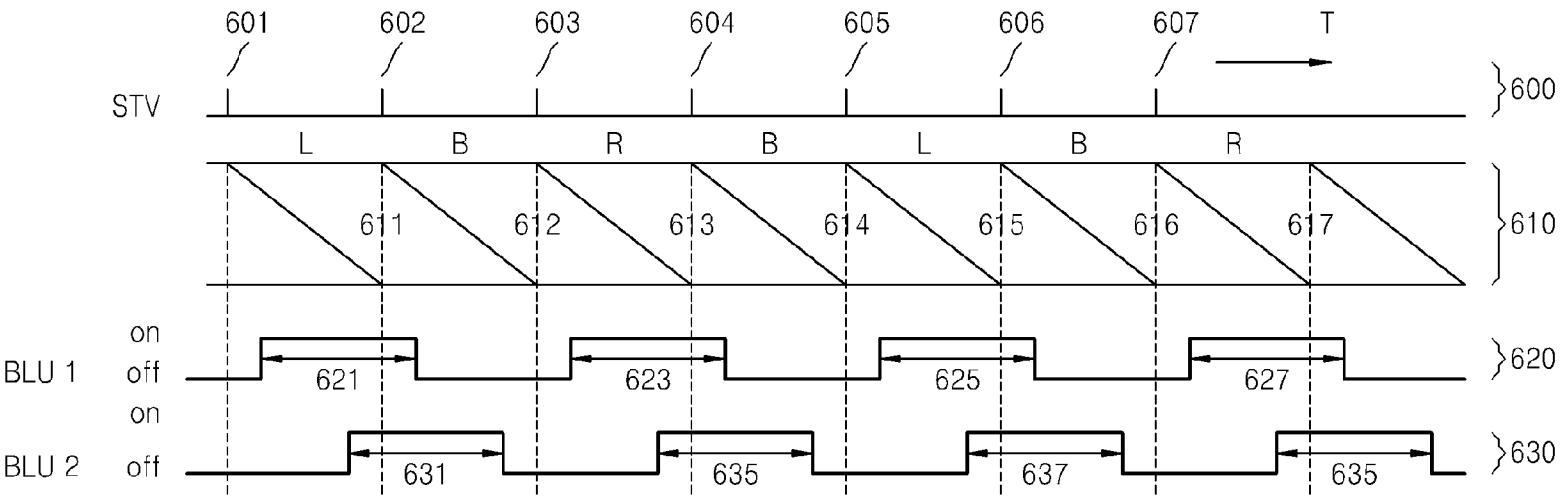
FIG. 6 is a timing diagram of a turn-on time of a backlight unit which is adjusted according to the one or more embodiments, when the image brightness level of a 3D video sequence is high.

FIG. 5 is a timing diagram of a turn-on time of a backlight unit which is adjusted according to the one or more exemplary embodiments, when the image brightness level of a 3D video sequence is low. FIG. 6 is a timing diagram of a turn-on time of a backlight unit which is adjusted according to the one or more exemplary embodiments, when the image brightness level of a 3D video sequence is high.

Horizontal axes of display screen diagrams 510 and 610 indicate flow of time, and vertical axes of them indicate a height of a display screen of the LCD unit 110. Display screen diagrams 510 and 610 may show frames displayed on the display screen of LCD unit 110 according to flow of time. A video frame is displayed on an upper part of display screen of the LCD unit 110 and proceeds toward a lower part while being displayed. Thus, display screen diagrams 510 and 610 exhibit a line in which frames are displayed while proceeding downward along the horizontal axes and in a right direction according to the flow of time.

A first STV timing diagram 500 and a second STV timing diagram 600 show a generation period of vertical start pulse (STV) signals. According to first STV timing diagram 500, whenever each of STV signals 501, 502, 503, 504, 505, 506 and 507 are generated, each frame of a first 3D video sequence is displayed on the LCD unit 110. According to the second STV timing diagram 600, whenever each of STV signals 601, 602, 603, 604, 605, 606 and 607 are generated, each frame of a second 3D video sequence is displayed on LCD unit 110.

A set of left and right visual point frames of a 3D video sequence may include a left visual point frame, a black frame, a right visual point frame, and a black frame. Display screen diagram 510 illustrates a display screen on which the first 3D video sequence is displayed according to the first STV timing diagram 500. Whenever each of the STV signals 501, 502, 503, 504, 505, 506 and 507 is generated, frames of the first 3D video sequence are displayed in an order of a first left visual point frame 511, a black frame 512, a first right visual point frame 513, a black frame 514, a second left visual point frame 515, a black frame 516, and a second right visual point frame 517.

Similarly, display screen diagram 610 illustrates a display screen on which the second 3D video sequence is displayed according to second STV timing diagram 600. Whenever each of the STV signals 601, 602, 603, 604, 605, 606 and 607 is generated, frames of the second 3D video sequence are displayed in an order of a third left visual point frame 611, a black frame 612, a third right visual point frame 613, a black frame 614, a fourth left visual point frame 615, a black frame 616, and a fourth right visual point frame 617.

The image brightness level of the first left visual point frame 511, first right visual point frame 513, second left visual point frame 515, and second right visual point frame 517 of the first 3D video sequence is dimmer than a predetermined critical value, and the image brightness level of third left visual point frame 611, third right visual point frame 613, fourth left visual point frame 615, and fourth right visual point frame 617 is brighter than the predetermined critical value.

The control unit 140 of the backlight unit may turn on sub-blocks of the backlight unit 120 by synchronizing with a switching period between the left and right visual points in a set of left and right visual point frames of a 3D video sequence. Thus, control unit 140 of the backlight unit may perform a control operation so as to turn on the sub-blocks of backlight unit 120 when first left visual point frame 511, first right visual point frame 513, second left visual point frame 515, and second right visual point frame 517 of display screen diagram 510 are displayed and when third left visual point frame 611, third right visual point frame 613, fourth left visual point frame 615, and fourth right visual point frame 617 of display screen diagram 610 are displayed.

A first turn-on timing diagram 520 illustrates a turn-on period of an upper backlight unit BLU 1 of backlight unit 120 which is controlled by control unit 140 of the backlight unit, when the first 3D video sequence is displayed. A second turn-on timing diagram 530 illustrates a turn-on period of a lower backlight unit BLU 2 of backlight unit 120, which is controlled by control unit 140 of the backlight unit, when the first 3D video sequence is displayed. Similarly, a third turn-on timing diagram 620 and a fourth turn-on timing diagram 630 respectively illustrate turn-on periods of upper and lower backlight units BLU 1 and BLU 2 of backlight unit 120 which are controlled by control unit 140 of the backlight unit, when the second 3D video sequence is displayed.

Thus, first turn-on timing diagram 520 of upper backlight unit BLU 1 of the backlight unit 120 illustrates that turn-on periods 521, 523, 525, and 527 of the upper backlight unit BLU 1 occur when first left visual point frame 511, first right visual point frame 513, second left visual point frame 515, and second right visual point frame 517 of the first 3D video sequence are displayed on the display screen. Similarly, second turn-on timing diagram 530 of lower backlight unit BLU 2 of the backlight unit 120 illustrates that turn-on periods 531, 533, 535, and 537 of lower backlight unit BLU 2 occur when first left visual point frame 511, first right visual point frame 513, second left visual point frame 515, and second right visual point frame 517 of first 3D video sequence are displayed on the display screen.

Similarly, third turn-on timing diagram 620 and fourth turn-on timing diagram 630 respectively illustrate the turn-on periods of the upper and lower backlight units. BLU 1 and BLU 2 of backlight unit 120 illustrate that turn-on periods 621, 623, 625 and 627 of the upper backlight unit BLU 1 and turn-on periods 631, 633, 635 and 637 of lower backlight unit BLU 2 occur when third left visual point frame 611, third right visual point frame 613, fourth left visual point frame 615, and fourth right visual point frame 617 of the second 3D video sequence, are displayed on the display screen.

Also, since a frame is displayed on an upper region of the display screen and then is displayed while progressing to a lower region, when one frame is displayed on the display screen, control unit 140 of the backlight unit may control the turn-on of backlight unit 120 so that an upper backlight unit of backlight unit 120 emitting light toward the upper region of the display screen may be turned on and off first, compared to a lower backlight unit.

Thus, first turn-on timing diagram 520 and second turn-on timing diagram 530 illustrate that turn-on periods 521, 523, 525, and 527 of the upper backlight unit BLU 1 are turned on and off first, compared to turn-on periods 531, 533, 535, and 537 of lower backlight unit BLU 2, when first left visual point frame 511, first right visual point frame 513, second left visual point frame 515, and second right visual point frame 517 of first 3D video sequence are displayed on the display screen. Similarly, according to third turn-on timing diagram 620 and fourth turn-on timing diagram 630, it is possible to verify that turn-on periods 621, 623, 625 and 627 of upper backlight unit BLU 1 are turned on and off first, compared to turn-on periods 631, 633, 635 and 637 of lower backlight unit BLU 2. This occurs when third left visual point frame 611, third right visual point frame 613, fourth left visual point frame 615, and fourth right visual point frame 617 of the second 3D video sequence are displayed on the display screen.

Sub-block turn-on time determining unit 150 may determine turn-on times of the sub-blocks of backlight unit 120 which are turned on by synchronizing with the switching period between the left and right visual points of the 3D video sequence. Sub-block turn-on time determining unit 150 may determine a turn-on time of the backlight unit 120 based on brightness of an image displayed on LCD unit 110. Sub-block turn-on time determining unit 150 may adjust a turn-on time with respect to first 3D video sequence whose image brightness level is less than a predetermined critical value, so that the turn-on time may be shorter than a predetermined turn-on time. Also, sub-block turn-on time determining unit 150 may adjust a turn-on time with respect to the second 3D video sequence whose image brightness level is greater than a predetermined critical value, so that the turn-on time may be longer than the predetermined turn-on time.

Thus, according to the turn-on timing diagram 520, second turn-on timing diagram 530, third turn-on timing diagram 620 and fourth turn-on timing diagram 630, it is possible to see that turn-on periods 521, 523, 525, and 527 of upper backlight unit BLU 1 and turn-on periods 531, 533, 535, and 537 of lower backlight unit BLU 2, which emit light to the first 3D video sequence, are controlled to be shorter than the turn-on periods 621, 623, 625 and 627 of the upper backlight unit BLU 1 and turn-on periods 631, 633, 635 and 637 of lower backlight unit BLU 2, which emit light to the second 3D video sequence.

When a frame period of the first 3D video sequence and the second 3D video sequence is 240 Hz, sub-block turn-on period determining unit 160 may determine a turn-on period of backlight unit 120 as 120 Hz that is one half of the frame period, so that backlight unit 120 may be turned on whenever the left and right visual points are switched.

Figure 7:
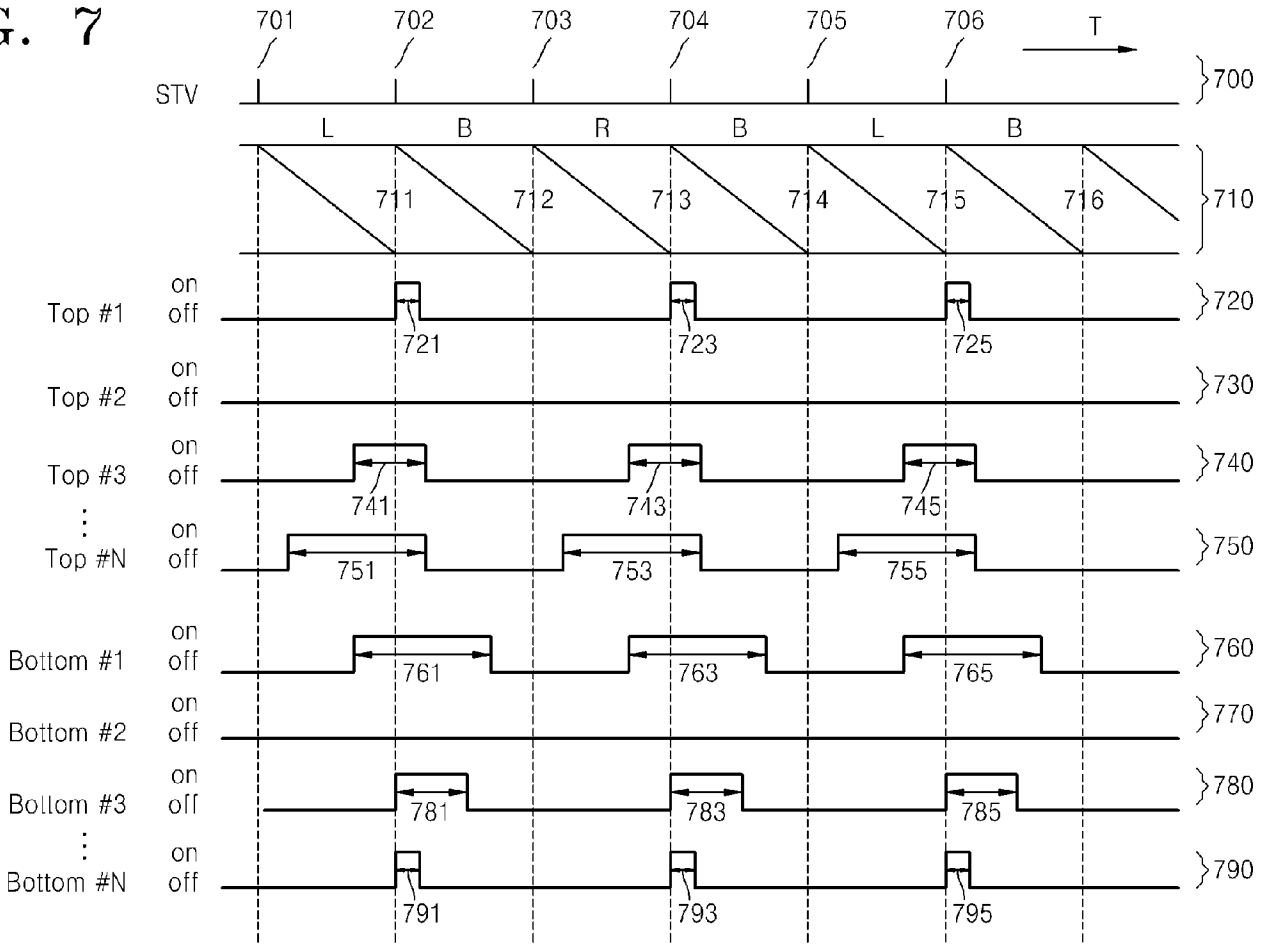
FIG. 7 is a timing diagram of turn-on times that are respectively adjusted for sub-blocks of a backlight unit, according to an exemplary embodiment.

FIG. 7 is a timing diagram of turn-on times that are respectively adjusted for sub-blocks of a backlight unit, according to an exemplary embodiment.

According to a STV timing diagram 700 and a display screen diagram 710, whenever each of STV signals 701, 702, 703, 704, 705 and 706 is generated, frames of a third 3D video sequence are displayed in an order of a fifth left visual point frame 711, a black frame 712, a fifth right visual point frame 713, a black frame 714, a sixth left visual point frame 715 and a black frame 716. Although not illustrated in FIG. 7, a sixth right visual point frame and a black frame may be displayed after black frame 716.

A first upper sub-block turn-on timing diagram 720, a second upper sub-block turn-on timing diagram 730, a third upper sub-block turn-on timing diagram 740, and an $N_{th}$ upper sub block turn-on timing diagram 750 respectively illustrate turn-on periods of a first sub-block, a second sub-block, a third sub-block, and an $N_{th}$ sub-block of an upper backlight unit of the backlight unit 120 which is controlled by the control unit 140 of the backlight unit, when the third 3D video sequence is displayed. A first lower sub-block turn-on timing diagram 760, a second lower sub-block turn-on timing diagram 770, a third lower sub-block turn-on timing diagram 780, and an $N_{th}$ lower sub-block turn-on timing diagram 790 respectively illustrate turn-on periods of a first sub-block, a second sub-block, a third sub-block, and an $N_{th}$ sub-block of an lower backlight unit of the backlight unit 120 which is controlled by control unit 140 of the backlight unit, when the third 3D video sequence is displayed.

According to the first upper sub-block turn-on timing diagram 720, the second upper sub-block turn-on timing diagram 730, the third upper sub-block turn-on timing diagram 740, and the $N_{th}$ upper sub-block turn-on timing diagram 750, when the fifth left visual point frame 711, the fifth right visual point frame 713 and the sixth left visual point frame 715 of the third 3D video sequence are displayed, turn-on periods 721, 723, and 725 of the first sub-block of the upper backlight unit, turn-on periods 741, 743, and 745 of the third sub-block of the upper backlight unit, and turn-on periods 751, 753, and 755 of the $N_{th}$ sub-block of the upper backlight unit occur. Second upper sub-block turn-on timing diagram 730 illustrates that the second sub-block of the upper backlight unit is not turned on.

Similarly, according to first lower sub-block turn-on timing diagram 760, second lower sub-block turn-on timing diagram 770, third lower sub-block turn-on timing diagram 780, and $N_{th}$ lower sub-block turn-on timing diagram 790, when fifth left visual point frame 711, fifth right visual point frame 713, and sixth left visual point frame 715 of the third 3D video sequence are displayed, turn-on periods 761, 763, and 765 of the first sub-block of the lower backlight unit, turn-on periods 781, 783, and 785 of the third sub-block of the lower backlight unit, and turn-on periods 791, 793, and 795 of the $N_{th}$ sub-block of lower backlight unit occur. The second lower sub-block turn-on timing diagram 770 illustrates that the second sub-block of the lower backlight unit is not turned on.

Sub-block turn-on time determining unit 150 may determine a turn-on time of a corresponding sub-block based on the image brightness level of a region to which each of the sub-blocks of the backlight unit 120 emits light. Although the sub-blocks of backlight unit 120 emit light with respect to the same frame, the sub-blocks may respectively emit light to different regions in the frame. Thus, sub-block turn-on time determining unit 150 may separately determine the turn-on times of the sub-blocks emitting light with respect to the same frame.

For example, although the sub blocks of the upper backlight unit emit light with respect to the fifth left visual point frame 711, a turn-on time of turn-on period 721 of the first sub-block, a turn-on time of turn-on period 741 of the third sub-block, and a turn-on time of the turn-on period 751 of the $N_{th}$ sub-block of the upper backlight unit may be separately determined based on the brightness level of an image to which each sub-block emits light. Similarly, although the sub-blocks of the lower backlight unit emit light with respect to fifth right visual point frame 713, a turn-on time of turn-on period 763 of the first sub-block, a turn-on time of turn-on period 783 of the third sub-block, and a turn-on time of turn-on period 793 of the $N_{th}$ sub-block of the lower backlight unit may be separately determined based on the brightness level of an image to which each sub-block emits light.

Also, a sub-block of the upper backlight unit and a sub-block of the lower backlight unit that face each other emit light to different regions, so that the sub-block turn-on time determining unit 150 may separately determine turn-on times of the sub-block of the upper backlight unit and the sub block of the lower backlight unit.

As described above, a turn-on time becomes longer as the brightness level of an image of a display screen region to which each sub-block emits light becomes higher, and a turn-on time becomes shorter as the brightness level of an image of the display screen region becomes dimmer. In particular, when it is not necessary to emit light since an image is very dim, as shown in the second upper sub-block turn-on timing diagram 730, the second sub-block may not be turned on.

For example, according to first upper sub-block turn-on timing diagram 720, third upper sub-block turn-on timing diagram 740, and $N_{th}$ upper sub-block turn-on timing diagram 750, image brightness of a region to which each sub-block emits light becomes higher in an order of the first sub-block, the third sub-block, and the $N_{th}$ sub-block of the upper backlight unit, so that turn-on times are controlled to become longer in an order of the turn-on periods 721, 723, and 725 of the first sub-block of the upper backlight unit, the turn-on periods 741, 743, and 745 of the third sub-block of the upper backlight unit, and the turn-on periods 751, 753, and 755 of the $N_{th}$ sub-block of the upper backlight unit.

Similarly, according to the first lower sub-block turn-on timing diagram 760, the third lower sub-block turn-on timing diagram 780, and the $N_{th}$ lower sub-block turn-on timing diagram 790, the image brightness level of a region to which each sub-block emits light becomes dimmer in an order of the first sub-block, the third sub-block, and the $N_{th}$ sub-block of the lower backlight unit, so that turn-on times are controlled to become shorter in an order of turn-on periods 761, 763, and 765 of the first sub-block of the lower backlight unit, turn-on periods 781, 783, and 785 of the third sub-block of the lower backlight unit, and turn-on periods 791, 793, and 795 of the $N_{th}$ sub-block of the lower backlight unit.

Figure 8:
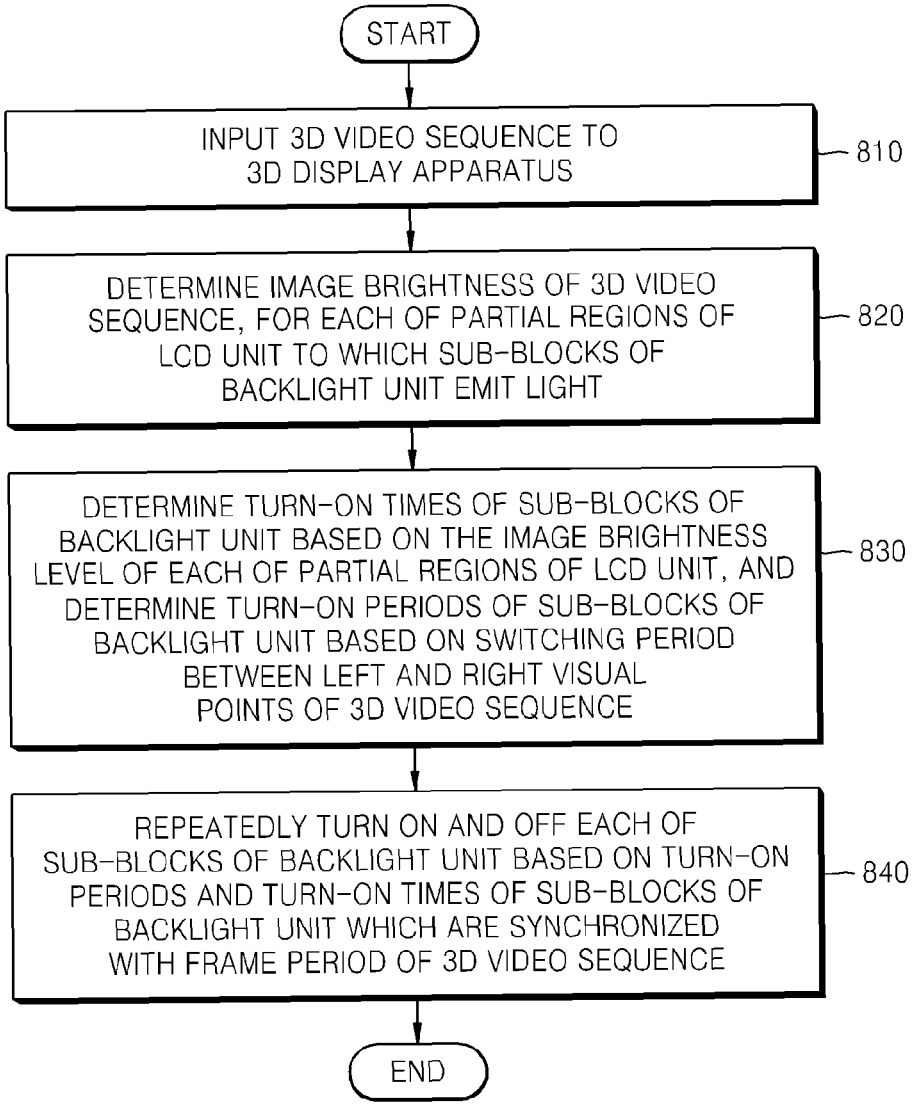
FIG. 8 is a flowchart of a method of controlling the backlight unit of the 3D display apparatus, according to an exemplary embodiment.

FIG. 8 is a flowchart of a method of controlling backlight unit 120 of the 3D display apparatus 100, according to an exemplary embodiment.

In operation 810, a 3D video sequence is input to 3D display apparatus 100 formed of LCD unit 110, backlight unit 120, and light guide plate 130. Backlight unit 120 may have a one-sided edge structure or a two-sided edge structure. Backlight unit 120 may be partitioned into a plurality of sub-blocks. Light guide plate 130 may be partitioned according to directions in which the sub-blocks of the backlight unit 120 emit light.

In operation 820, image brightness of the 3D video sequence displayed on LCD unit 110 is determined for each of partial regions of LCD unit 110 to which sub-blocks of backlight unit 120 emit light. In operation 830, turn-on times of the sub-blocks of the backlight unit 120 are determined based on image brightness level of each of the partial regions of the LCD unit 110. Turn-on periods of the sub-blocks of backlight unit 120 are determined by synchronizing with a switching period between a set of a left visual point frame and a right visual point frame of the 3D video sequence.

The turn-on times of the sub-blocks of backlight unit 120 may be determined based on image brightness of each of the partial regions to which light is emitted. As the image brightness of each of the partial regions to which the sub blocks of backlight unit 120 emit light becomes higher, the turn-on times of the sub-blocks may become longer As the image brightness becomes dimmer, the turn-on times may become shorter.

When N frames are displayed before left and right visual points of the set of the left visual point frame and the right visual point frame are switched, the turn-on periods of the sub-blocks of backlight unit 120 is determined as 1/N of a frame period of the 3D video sequence, so that the turn-on periods of the sub-blocks of backlight unit 120 may be determined to be N times slower than the frame period of the 3D video sequence.

In operation 840, based on the turn-on periods and the turn-on times of the sub-blocks of backlight unit 120 which are separately adjusted by synchronizing with the frame period of the 3D video sequence, each of the sub-blocks of the backlight unit 120 is repeatedly turned on and off.

The exemplary embodiments of the present invention can be written as computer programs and can be implemented in general-use digital computers that execute the programs using a computer readable recording medium, including a non-transitory computer-readable storage medium. Examples of the computer readable recording medium include magnetic storage media (e.g., ROM, floppy disks, hard disks, etc.), optical recording media (e.g., CD-ROMs, or DVDs), etc.

While this invention has been particularly shown and described with reference to exemplary embodiments thereof, it will be understood by those of ordinary skill in the art that various changes in form and details may be made therein without departing from the spirit and scope of the invention as defined by the appended claims. The exemplary embodiments should be considered in a descriptive sense only and not for purposes of limitation. Therefore, the scope of the invention is defined not by the detailed description of the invention but by the appended claims, and all differences within the scope of the claims will be construed as being included in the exemplary embodiments of the present invention.

What is claimed is:

1. A method of controlling a backlight unit of a three-dimensional (3D) display apparatus formed of a liquid crystal display (LCD) unit including a plurality of partial units, a backlight unit and a light guide plate, the method comprising:

inputting a 3D video sequence to the 3D display apparatus;

determining an image brightness level of the 3D video sequence displayed on the LCD unit, for each of partial regions of the LCD unit to which a plurality of sub-blocks of the backlight unit emit light;

determining turn-on times for the plurality of sub-blocks of the backlight unit, based on the image brightness level of each of the partial regions of the LCD unit;

determining the turn-on periods for the plurality of sub-blocks of the backlight unit by synchronizing with a frame period of the 3D video sequence and a switching period between a set including a left visual point frame and a right visual point frame of the 3D video sequence; and repeatedly turning on and off each of the plurality of sub-blocks of the backlight unit, based on both the turn-on times and the turn-on periods of the plurality of sub-blocks of the backlight unit, wherein the sub-blocks of the backlight unit are separately adjusted by being synchronized with a frame period of the 3D video sequence, wherein a turn-on time for a sub-block of the backlight unit indicates time duration from a turn-on point to a turn-off point of the sub-block of the backlight unit, wherein a turn-on period for a sub-block of the backlight unit indicates time duration from the turn-on point to the subsequent turn-on point of the sub-block of the backlight unit, wherein the turn-on times for the plurality of sub-blocks of the backlight unit are differently determined with respect to same frame, and wherein the turn-on periods of the sub-blocks of upper backlight unit are determined to be longer from one sub-block to a next sub-block along a first direction, and the turn-on periods of the sub-blocks of lower backlight unit are determined to be shorter from one sub-block to a next sub-block along the first direction.

2. The method of claim 1, wherein the determining of the turn-on times comprises:

adjusting the turn-on times to be long when the brightness level of each of the partial regions of the 3D video sequence is high, and adjusting the turn-on times to be short when the brightness level of each of the partial regions of the 3D video sequence is low.

3. The method of claim 1, wherein the determining of the turn-on periods comprises:

determining the turn-on periods of the plurality of sub-blocks of the backlight unit to be slower than a frame period of the 3D video sequence, the turn-on periods being determined by the number of frames displayed before the set including the left visual point frame and the right visual point frame of the 3D video sequence are switched.

4. The method of claim 1, wherein the determining of the image brightness of the 3D video sequence comprises:

classifying the plurality of sub-blocks of the backlight unit into sub-block groups comprising the predetermined number of sub-blocks that are sequentially arranged in the plurality of sub-blocks of the backlight unit, and the determining of the image brightness level includes determining the image brightness level for each of the partial regions of the LCD unit to which the sub-block groups of the backlight unit emit light, and wherein the determining of the turn-on times comprises determining the turn-on times of the sub-block groups of the backlight unit based on the image brightness level for each of the partial regions of the LCD unit to which the sub-block groups of the backlight unit emit light.

5. The method of claim 1, wherein the set including a left visual point frame and a right visual point frame of the 3D video sequence comprises:

a frame set comprising a first left visual point frame, a black frame and a first right visual point frame that are displayed in an order of the first left visual point frame, the black frame, the first right visual point frame, and the black frame.

6. The method of claim 1, wherein, when the backlight unit has a two-sided edge structure, and a backlight unit of a first side and a backlight unit of a second side are separately controlled.

7. The method of claim 1, wherein, when the backlight unit has a two-sided edge structure, a backlight unit of a first side and a backlight unit of a second side are equally controlled.

8. The method of claim 1, wherein the plurality of sub-blocks of the backlight unit are separately controlled.

9. The method of claim 1, wherein the light guide plate of the 3D display apparatus is partitioned into a plurality of sub-plates according to positions of the plurality of sub-blocks, the sub-plates are parallel with a direction of light emitted from each of the plurality of sub-blocks of the backlight unit.

10. The method of claim 1, wherein the light guide plate of the 3D display apparatus is partitioned into a plurality of sub-plates according to a side edge structure of the backlight unit.

11. A three-dimensional (3D) display apparatus comprising:

a liquid crystal display (LCD) unit including a plurality of partial regions; said LCD display unit displaying an image of an input 3D video sequence;

a backlight unit partitioned into a plurality of sub-blocks that separately emit light to the LCD unit;

a light guide plate delivering the light emitted from the backlight unit; and the backlight unit includes a control unit which controls light sources of the backlight unit, wherein the control unit of the backlight unit comprises:

a sub-block turn-on time determining unit which determines image brightness of the 3D video sequence displayed on the LCD unit, for each of partial regions of the LCD unit to which the plurality of sub-blocks of the backlight unit emit light; said sub-block turn-on time determining unit determining turn-on times for the plurality of sub-blocks of the backlight unit, based on an image brightness level of each of the partial regions of the LCD unit; and the sub-block turn-on period determining unit determines turn-on periods for the plurality of sub-blocks of the backlight unit said sub-block turn-on period determining unit synchronizing with a frame period of the 3D video sequence and a switching period between a set including a left visual point frame and a right visual point frame, of the 3D video sequence, wherein a turn-on time for a sub-block of the backlight unit indicates time duration from a turn-on point to a turn-off point of the sub-block of the backlight unit, and wherein a turn-on period for a sub-block of the backlight unit indicates time duration from the turn-on point to the subsequent turn-on point of the sub-block of the backlight unit, wherein the control unit of the backlight unit repeatedly turns on and off each of the plurality of sub-blocks of the backlight unit, the turn-on and turn-off is based on both the turn-on times and the turn-on periods of the plurality of sub-blocks of the backlight unit, which are separately adjusted by being synchronized with a frame period of the 3D video sequence, wherein the sub-block turn-on time determining unit differently determines the turn-on times for the plurality of sub-blocks of the backlight unit with respect to same frame, wherein the sub-block turn-on period determining unit determines the turn-on periods of the sub-blocks of upper backlight unit to be longer from one sub-block to a next sub-block along a first direction, and determines the turn-on periods of the sub-blocks of lower backlight unit to be shorter from one sub-block to a next sub-block along the first direction.

12. The 3D display apparatus of claim 11, wherein the sub-block turn-on time determining unit adjusts the turn-on times to be long when the brightness level of each of the partial regions of the 3D video sequence is high, and adjusts the turn-on times to be short when the brightness level of each of the partial regions of the 3D video sequence is low.

13. The 3D display apparatus of claim 11, wherein the sub-block turn-on period determining unit determines the turn-on periods of the plurality of sub-blocks of the backlight unit to be slower than a frame period of the 3D video sequence;

the turn-on periods are determined by the number of frames displayed before the set including the left visual point frame and the right visual point frame of the 3D video sequence are switched.

14. The 3D display apparatus of claim 11, wherein the sub-block turn-on time determining unit classifies the plurality of sub-blocks of the backlight unit into sub-block groups comprising the predetermined number of sub-blocks that are sequentially arranged in the plurality of sub-blocks of the backlight unit: the sub-block turn-on time determining unit determines the image brightness for each of the partial regions of the LCD unit to which the sub-block groups of the backlight unit emit light, and the sub-block turn-on time determining unit determines the turn-on times of the sub-block groups of the backlight unit based on the image brightness level of each of the partial regions of the LCD unit to which the sub-block groups of the backlight unit emit light.

15. The 3D display apparatus of claim 11, wherein the set including a left visual point frame and a right visual point frame of the 3D video sequence comprises:

a frame set comprising a first left visual point frame, a black frame and a first right visual point frame that are displayed in an order of the first left visual point frame, the black frame, the first right visual point frame, and the black frame.

16. The 3D display apparatus of claim 11, wherein, when the backlight unit has a two-sided edge structure, the control unit of the backlight unit separately controls a backlight unit of a first side and a backlight unit of a second side.

17. The 3D display apparatus of claim 11, wherein, when the backlight unit has a two-sided edge structure, the control unit of the backlight unit equally controls a backlight unit of a first side and a backlight unit of a second side.

18. The 3D display apparatus of claim 11, wherein the control unit of the backlight unit separately controls the plurality of sub-blocks of the backlight unit.

19. The 3D display apparatus of claim 11, wherein the light guide plate is partitioned into a plurality of sub-plates according to positions of the plurality of sub-blocks so as to be parallel with a direction of light emitted from each of the plurality of sub-blocks of the backlight unit.

20. The 3D display apparatus of claim 11, wherein the light guide plate is partitioned into a plurality of sub-plates according to a side edge structure of the backlight unit.

21. A non-transitory computer readable recording medium having recorded thereon a program, wherein the program, when executed on a processor of a computer causes the computer to execute the method of controlling a backlight unit of a three-dimensional (3D) display apparatus of claim 1.

* * * * *